US006694247B2

(12) United States Patent
Hameleers et al.

(10) Patent No.: US 6,694,247 B2
(45) Date of Patent: Feb. 17, 2004

(54) TRAFFIC MANAGEMENT SYSTEM INCLUDING A LAYERED MANAGEMENT STRUCTURE

(75) Inventors: Heino Hameleers, Kerkrade (NL); Frank Hundscheidt, Kerkrade (NL)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 224 days.

(21) Appl. No.: 09/989,104

(22) Filed: Nov. 21, 2001

(65) Prior Publication Data

US 2002/0062190 A1 May 23, 2002

(30) Foreign Application Priority Data

Nov. 23, 2000 (EP) ..... 00125249

(51) Int. Cl.[7] ..... G08G 1/00
(52) U.S. Cl. ..... 701/117; 701/118; 340/907
(58) Field of Search ..... 701/117, 118, 701/119; 340/905, 907

(56) References Cited

U.S. PATENT DOCUMENTS

| | | | | | |
|---|---|---|---|---|---|
| 5,182,555 | A | * | 1/1993 | Sumner | 340/905 |
| 5,289,183 | A | * | 2/1994 | Hassett et al. | 340/905 |
| 5,533,014 | A | | 7/1996 | Willars et al. | |
| 5,696,503 | A | * | 12/1997 | Nasburg | 340/933 |
| 5,801,943 | A | * | 9/1998 | Nasburg | 701/117 |
| 5,875,183 | A | | 2/1999 | Nitadori | |
| 5,896,368 | A | | 4/1999 | Dahlman et al. | |
| 6,587,781 | B2 | * | 7/2003 | Feldman et al. | 701/117 |

FOREIGN PATENT DOCUMENTS

| | | |
|---|---|---|
| WO | 99/22353 | 5/1999 |
| WO | 00/11629 | 3/2000 |

OTHER PUBLICATIONS

Gleissner, "Von Verkehrsdurchsage bis Mautstation", Funkschau, DE, Franzis–Verglag K.G. Munchen, vol. 63, No. 7, Mar. 22, 1991, pp. 73–75, 78, XP000224977.

Gustafsson et al, "Compressed Mode Techniques for Inter–Frequency Measurements in a Wide–band DS–CDMA System", Waves of the Years 2000+ PIMRC '97, the 8$^{th}$ IEEEE Int'l. Symposium on Personal, Indoor and Mobile Radio Communications Technical Program, Proceedings (CAT. No. 97$^{TH}$8271), Helsinki, FI, Sep. 1–4, 1997, vol. 1, pp. 231–235, XP002127494.

Tech. Spec. TS 25.231, V0.3.0, 3$^{rd}$ Generation Partnership Project (3GPP); Technical Specification Group (TSG); Radio Access Network; Working Group 1; Physical Layer—Measurements, 1999–06, XP–002127381.

International Search Report mailed May 28, 2002.

European Search Report mailed Jan. 28, 2000.

USSN 09/989,108 filed Nov. 21, 2001 published on May 30, 2002 as 2002–0065599 A1.

* cited by examiner

*Primary Examiner*—Gary Chin
(74) *Attorney, Agent, or Firm*—Nixon & Vanderhye, P.C.

(57) ABSTRACT

The invention relates to a traffic management system (TMSYS) including a layered structure of management layers. The system comprises a physical layer (PL) on which the actual traffic takes place. A traffic signalling layer (TSL) controls the traffic on the physical layer (PL) and collects traffic information (TSI) about the vehicle traffic. A traffic control layer (TCL) comprises a packet switched control network (PSCN) for routing packets to correspond or simulate the vehicle traffic. A service application layer (SAL) provides special services to the traffic control layer (TCL) and/or the traffic signalling layer (TSL). A communication layer (CL) is used for communicating the information. Each layer comprises an exchange interface for receiving/transmitting information to one or more of the other layers. The layered structure of the traffic management system allows in particular a flexible adaptation, exchange or extension of functionalities provided in each layer.

5 Claims, 3 Drawing Sheets

TRAFFIC MANAGEMENT SYSTEM INCLUDING A LAYERED MANAGEMENT STRUCTURE

FIELD OF THE INVENTION

The present invention relates to a traffic management system for managing in a road network the vehicle traffic formed on a physical layer by a plurality of vehicles.

In particular, the present invention addresses the problem of how an effective traffic management system can be devised, which can be adapted, changed and extended easily to provide different types of traffic management depending on the prevailing traffic conditions in the physical layer in order to provide different types of intelligence for an effective traffic management. The different types of traffic management concern the traffic management aspect of merely effectively monitoring the existing traffic as well as the traffic management aspect of effectively controlling the traffic. The different types of traffic management include for example different types of effective settings of traffic control signs, various different route-planings by not only considering traffic jams and congestions but also road charging, the gathering of statistical data from existing traffic, the prevention of dangerous or generally unwanted traffic situations by changing traffic signs in case of dangerous traffic situations, as well as the achieving of different traffic situations with different traffic control mechanisms.

Thus, the traffic management system of the invention should generally be flexible in its control and in its extension and adaption functions.

BACKGROUND OF THE INVENTION

With the ever increasing demands to growing mobility, the automobile industry has developed the vehicular technology to such a degree that now a range of products for various purposes and missions are available and an adequate cost-benefit balance can be provided for every application. On the other hand, the growing demand to mobility has caused the need for the public authorities to extend the old network of roads and highways to cope with the ever increasing traffic.

However, the expansion of the network and the related infrastructure has been notably smaller than the increase of the number of vehicles. That is, the existing road networks cannot cope with the ever increasing traffic and this unbalance causes traffic situations with congestions and accidents. Other consequences are an increased fuel consumption, general waste of time, the environmental pollution, noise, stress and other discomfort for humans. Apart from not very effective counter measures to stop the growth of the traffic, such as increasing fuel cost and higher taxation, there are no effective counter measures with which the gap between the mobility demand and the necessary infra-structural means can be bridged which leads to higher transportation costs, waste of fuel and time, environmental problems as well as a lower safety level.

These circumstances have resulted in a high demand for effective traffic control measures to avoid a collapse of a complete transportation system. Therefore, it is now generally accepted that a wide range of more global and integrated measures have to be identified and implemented together with a systematic approach. In particular, the demands to a new traffic control system are to balance the demand and offer within the whole transport system, i.e. to manage the transport resources (roads, traffic signs etc., traffic flow control) to be optimally adapted to the traffic situations and demands (i.e. number of vehicles, type of vehicles, desired destination etc.).

At present several new approaches for more effective traffic (congestion) control systems are tested, in particular in the Netherlands. However, most of the traffic control systems existing today are of a rather static nature. Only some of them use changeable traffic signs depending on the time of day or the actual traffic situation, e.g. a variable speed limit on a motorway depending on the congestion condition. Thus, only a few traffic signs (such as parking permission, speed limit, use of one or two lanes on a road) may have a different meaning depending on the time of day or the day of the month and they are not controlled in an integrated manner, i.e. they do not take into account a traffic situation which exists elsewhere (away from the road section where e.g. the particular variable speed limit is arranged) but which may also have an influence on the road section considered.

For monitoring purposes certain highways are on a limited scale equipped with sensors, which measure the traffic flow and provide information in the traffic loads or bad weather conditions in order to change some traffic signs mounted above the highway to indicate dangerous situations. However, this change of warning signs like bad weather conditions, accident and congestion only change the traffic signs on the highways in a very limited scale, namely on a rather local scale rather than being able to more globally control the complete traffic flow for example in an integrated manner in a whole area of for example one or two local areas, e.g. a complete city.

Conventional Traffic Management Systems

On a rather limited scale traffic management systems are already available or are being currently tested. In one system called the "Intelligente Snelheidsadaptor" (Intelligent Speed Control) tested in the Netherlands, a vehicle is equipped with a traffic information unit and a speed broadcasting system of the traffic information system receives some traffic information from a traffic information system and broadcasts the appropriate speed in each area of a road network. This system is very specifically directed to speed control in a limited area and no provisions are made for including further control of traffic situations on a global basis.

In another systems called the "Rekening-Rijden" (Tag Billing System) some sensors are arranged at certain road points to sense the passing of a vehicle with an identification tag. This system only performs a monitoring of the traffic and allows to charge persons who have used a road more accurately.

On the other hand, route-planners (mostly employed in vehicle navigation systems) are fairly static and do not take into account road-blocks, congestions, i.e. the actual traffic situation. Here, the traffic management system merely employs on-board-computers, which inform the driver about the shortest route to the corresponding destination.

Mobile radio communication systems such as GSM (Global System of Mobile Communication), GPRS (General Packet Routing System) and UMTS (Universal Mobile Telephone System) are also partially used in traffic management systems. A GPS (Global Positioning System) system is used to determine the location and speed of a vehicle and a central control office is informed when a certain amount of vehicles is lower than usual. A SMS message (Short Message System) can be broadcasted to all mobile stations in a corresponding region to advise them to select another route. The other routes are manually selected and there is as such no actual traffic flow control by using particular control methodologies.

As may be appreciated from the above description, there are various traffic management systems, which perform some kind of monitoring and limited control of the vehicle traffic, however, the systems are set up in such a specific manner that even their integration or combination is difficult, i.e. each system is developed independently and has thus a very rigid construction geared to a specific purpose such that an extension or modification is not easily possible. Thus, if there arise traffic situations in the future with which the static conventional traffic management systems cannot cope, then it is required to develop a completely new system. The reason for this is that the conventional traffic management systems where only designed very specifically for a single specific test purpose, i.e. monitoring or a speed indication, such that a further extension and modification was never contemplated for these test systems.

SUMMARY OF THE INVENTION

As explained above, conventional traffic management systems are geared so specifically to a certain control purpose or monitoring purpose such that the system cannot easily be extended, modified or adapted to more complicated traffic situations or more complicated control if the traffic situation changes, in particular if the traffic situation changes on a global bases. That is, in the conventional systems the whole traffic management system operates on a single layer in which the collecting of information about traffic flow, the control as well as the communication of various types of traffic messages are exchanged. Thus, every time a new function is to be added, this will mean a complete redesign of the system, which is extremely tedious, user-unfriendly and cost-intensive.

Therefore, the object of the present invention is the provision of

- a traffic management system which can easily be modified, extended and adapted to new traffic situations and traffic control scenarios.

This object is solved by a traffic management system comprising a layer structure including at least a traffic signalling layer including a plurality of traffic signalling units for monitoring and/or controlling the vehicle traffic and a traffic signalling layer information exchange interface adapted to output traffic signalling information about the vehicle traffic on the physical layer; to receive traffic control information for controlling the vehicle traffic; and to output traffic guidance information to the vehicles on the physical layer; and a traffic control layer including a packet switched control network, in which the packet traffic is controlled with a predetermined packet control method to correspond to or simulate the vehicle traffic on the physical layer, including a traffic control layer information exchange interface adapted to receive traffic signalling information about the vehicle traffic on the physical layer; to output traffic control information for controlling the vehicle traffic; to output packet signalling information about the packet traffic; and to receive packet control information for controlling the packet traffic in the packet switched control network.

The traffic management system in accordance with the invention is a layered structure, in which at least two different layers are incorporated, to which specific traffic management functions are assigned. The exchange of messages between these layers is standardized such that a complete layer can be exchanged with a new layer without changing functions in other layers. Thus, one layer can be modified according to need without the requirement of redesigning the whole system.

Advantageous Embodiments

Further advantageous embodiments and improvements of the invention are listed in the dependent claims. Hereinafter, the invention will be described with reference to its advantageous embodiments and with respect to what is currently considered by the inventors to be the best mode of the invention.

Furthermore, it should be noted that the invention can be modified and varied in many respects on the basis of the teachings contained herein. For example, the invention may comprise embodiments, which are a result of combining features and steps which have been separately described and listed in the claims, drawings and in the description.

BRIEF DESCRIPTION OF THE DRAWINGS

It should be noted that in the drawings the same or similar reference numerals and designation of steps denote the same or similar parts in the description.

Furthermore, it should be noted that the packet switched control network of the invention, as described below, could be implemented by any type of packet-switching network and not only for example using the Internet protocol. Therefore, if in the description a specific reference is made to protocols and expressions used in a specific packet switching environment, it should be understood that this should by no means be regarded as restrictive for the invention. Therefore, the skilled person may find corresponding messages, steps and features in other packet switching environments, which are not specifically listed here.

Hereinafter, the invention will be described with respect to vehicle traffic involving vehicles driving on road sections of a road network. The term "vehicle" should however not be regarded as limiting the invention to any particular type of vehicle and likewise the term "road section" and "road network" should not be seen as being restricted to any particular type of "road section" and "road network".

For example, the vehicles comprise cars, motorcycles, trucks, bicycles or even pedestrians etc. driving or moving on a road network consisting of road sections formed by roads, streets, motorways etc. However, the vehicles also comprise vehicles which are rail-bound, i.e. trains, trams etc. driving on a railroad network formed of railroad sections. Also combinations are possible where the vehicles comprise both road-bound vehicles and rail-bound vehicles and where the road network comprises railroad sections as well as normal road sections. Thus, the term "road section" means any portion of a network on which a vehicle can move depending on its drive mechanism. In principle, the vehicles may also be extended to vessels and aircrafts where the "road sections" correspond to a predetermined travel route on sea or in the air between an origin and a destination. Thus, the invention contemplates various types of objects moving or travelling along a movement section or travel section for the vehicles and the road sections such that the invention is not limited to the specific examples explained below.

Overview of the Traffic Management System

Figure 1:
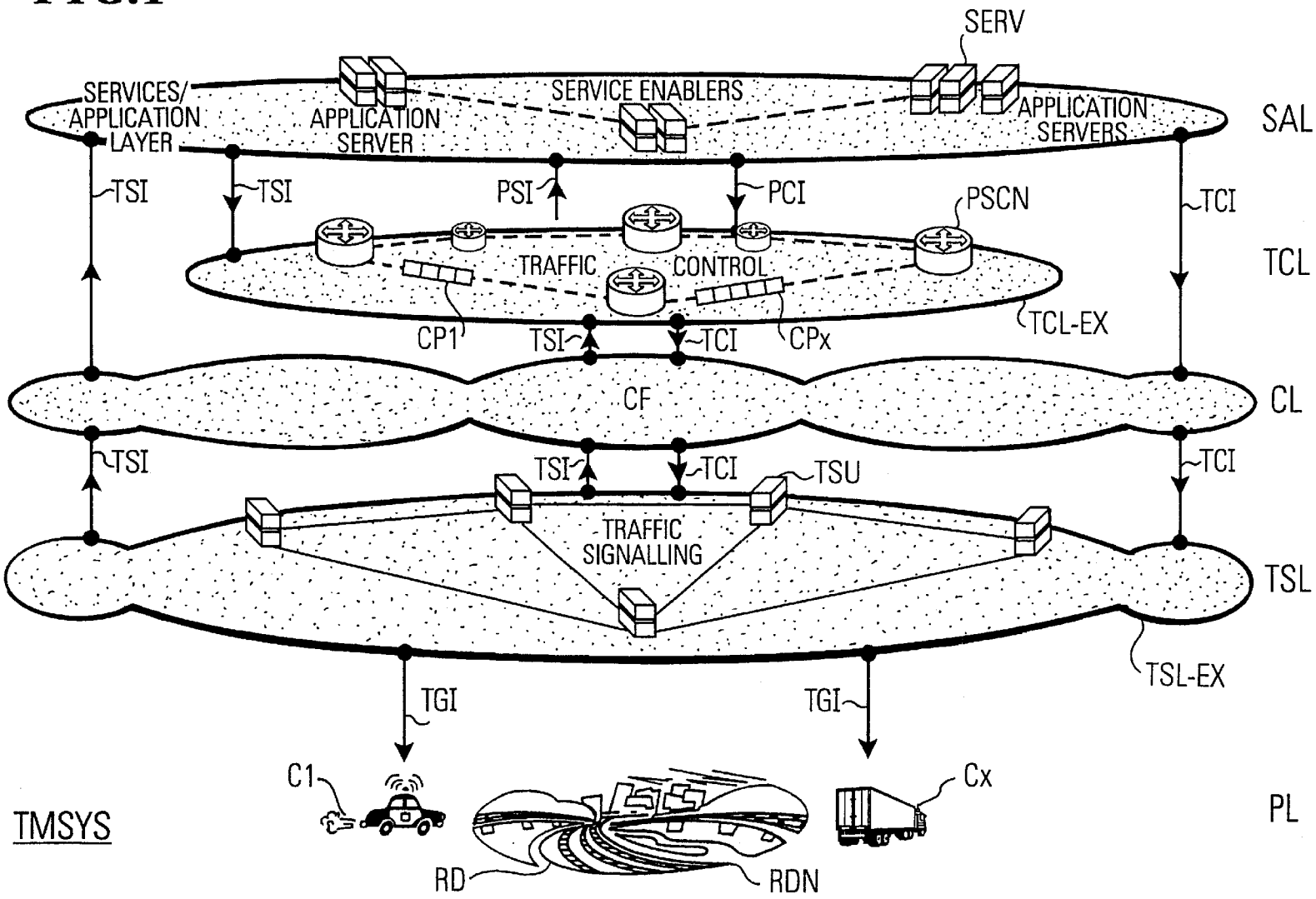
FIG. 1 shows an overview of the traffic management system TMSYS in accordance with the invention.

FIG. 1 shows an overview of the traffic management system TMSYS of the present invention. As shown in FIG. 1, essentially five different levels or layers can be distinguished. The physical layer PL is the layer where the actual traffic takes place. As illustrated in FIG. 1 the physical layer PL contains the vehicles C1, Cx and a road network RDN with a plurality of roads RD on which the vehicle traffic occurs, i.e. on which the vehicles drive. However, according to another embodiment, it also contains certain other topographical data, which may be taken into account for the traffic management, for example the inclination of roads in mountainous areas or the occurrence of lakes or rivers in the topography. Furthermore, the physical layer PL may also comprise the people who drive the vehicles and to whom information is provided. Furthermore, the physical layer PL also comprises pedestrians who may receive information about traffic jams etc., for example, as a warning about heavy traffic areas which should be avoided due to dangerous traffic conditions or because of health reasons.

In order to provide a traffic management for managing the vehicle traffic on the physical layer PL, the traffic management system TMSYS includes in the layer structure shown in FIG. 1 at least a traffic signalling layer TSL and a traffic control layer TCL. Both layers TSL, TCL comprise a unified exchange interface TSL-EX, TCL-EX for receiving and transmitting specific information, which is necessary to provide the traffic management for the vehicle traffic on the physical layer PL. Furthermore, each layer TSL, TCL may itself comprise several traffic signalling domains and traffic control domains, which in turn cooperate by the exchange of information to domain interfaces.

The traffic signalling layer TSL includes a plurality of traffic signalling units TSU, which are, as shown in FIG. 1, provided for monitoring and/or controlling the vehicle traffic C1, Cx on the physical layer PL. The traffic signalling layer comprises a traffic signalling layer information exchange interface TSL-EX for exchanging information with the other layers and for providing information to the physical layer PL. The respective information received and transmitted (input/output) from the exchange interface TSL-EX may be directly received/transmitted by/to the traffic signalling units TSU. Alternatively, such information can also be coordinated by an internal server in the traffic signalling layer TSL. However, the specific way and specific type of the exchange information will be described with reference to FIG. 2 and also the traffic signalling units TSU will be described with more details in FIG. 2. Thus, FIG. 1 only lists in a general sense the exchange of information, which is necessary to provide the traffic management.

In this respect, the traffic signalling layer information exchange interface TSL-EX is adapted to output traffic signalling information TSI about the vehicle traffic C1, Cx on the physical layer PL, to receive traffic control information TCI for controlling the vehicle traffic C1, Cx, and to output traffic guidance information TGI the vehicles C1, Cx on the physical layer PL.

Whilst the information TSI, TCI, TGI are the essential information generated and received by the traffic signalling layer TSL for performing the traffic management, it should be understood and will be explained below that, depending on the structure of the traffic signalling units TSU, the traffic signalling information and the traffic control information may be specific signalling information and control information in connection with specific types of traffic signalling units TSU.

The traffic control layer TCL is the second important layer for providing the traffic management. The traffic control layer TCL includes a packet switched control network PSCN in which a packet traffic CP1, CPx formed by a plurality of packets is controlled with a predetermined packet control method to correspond to or simulate the vehicle traffic C1, Cx on the physical layer PL. Similarly as the traffic signalling layer TSL the traffic control layer TCL includes a traffic control layer information exchange interface TCL-EX. Furthermore, also the traffic control layer TCL may be subdivided into several traffic control domains, each having an interface and exchanging information amongst each other.

As shown in FIG. 1, the traffic control layer information exchange interface TCL-EX is adapted to receive traffic signalling information TSI about the vehicle traffic C1, Cx on the physical layer PL, to output traffic control information TCI for controlling the vehicle traffic C1, Cx, to output packet signalling information PSI about the packet traffic CP1, CPx, and to receive packet control information PCI for controlling the packet traffic in the packet switched network PSCN. Similarly as in the traffic signalling layer TSL it will depend on the particular internal structure of the packet switched control network PSCN what type of content the information PSI, PCI, TSI, TCI will have. Furthermore, the exchange of information shown in FIG. 1 is also the minimum amount of information which must be exchanged and of course, as will be seen below with reference to FIG. 3, the information flow will also contain additional information not shown in FIG. 1. For example, the packet control information PCI may comprise the packet control unit control information PCU-CI but also traffic guidance unit control information TGU-CU as shown with F6, F4' in FIG. 3. This will be explained below.

Summarizing, due to the layer structure of the traffic management system TMSYS shown in FIG. 1, each layer TSL, TCL only needs specific minimum information in order to perform the traffic management. The traffic signalling layer essentially guides the traffic by outputting traffic guidance information TGI. The exchange of information between TSL and TCL is governed by providing information TSI collected about the vehicle traffic to the traffic control layer whilst on the other hand the traffic control layer provides general control information TCI to the traffic signalling layer. In response to the traffic control information the traffic control layer TSL outputs the traffic guidance information. On the traffic control layer TCL packet signalling information PSI may be generated for processing purposes in other layers and, for example depending on the packet control method, packet control information is supplied to the traffic control layer and in turn, based on the packet control method and/or the packet control information PCI, the traffic control layer TCL generates the traffic control information TCI for controlling the traffic signalling layer TSL.

Thus, independent from the internal structure of the traffic control layer TCL and the traffic signalling layer TSL the general exchange interfaces and the general information being exchanged is sufficient to provide the inventive traffic management system TMSYS with the illustrated layer structure. Consequently, the traffic management system TMSYS is not restricted to any particular type of internal structure of the layers and each layer may easily be exchanged with another layer as long as it is guaranteed that an exchange interface is provided, which can receive and output the information described above.

For example, a traffic control layer having a specific arrangement and interconnection of routers and using a predetermined packet routing method may easily be exchanged with another traffic control layer having a different structure of the packet switched control network, i.e. a different structure of the routers and using a different type of packet control method.

Likewise, even for a given road network RN the traffic control layer TSL may comprise different types of traffic signalling units TSU and different interconnections of traffic signalling units TSU. However, as long as it is guaranteed that the traffic signalling layer TSL outputs/receives the aforementioned information, also the traffic signalling layer TSL can be exchanged by a different traffic signalling layer. Thus, different types of managements of the vehicle traffic can easily be obtained by simply exchanging some of the layers with a new layer. Thus, this provides an easy way to adapt the traffic management system to new types of layers to be developed in future.

As also shown in FIG. 1, a preferred embodiment of the traffic management system TMSYS in accordance with the invention comprises a further top layer, namely the service application layer SAL, which includes at least one server SERV for providing services to the traffic signalling layer TSL and/or the traffic control layer TCL. The service application layer SAL also comprises a service application layer information exchange interface SAL-EX. This information exchange interface SAL-EX is generally adapted to receive traffic signalling information TSI about the vehicle traffic C1, Cx on the physical layer PL, to receive packet signalling information PSI about the packet traffic CP1, CPx in the packet switched control network PSCN, to output packet control information PCI for controlling the packet traffic CP1, CPx, and to output a traffic control information PCI for controlling the vehicle traffic C1, Cx on the traffic signalling layer TSL. Yet again, the packet control information PCI and the traffic control information TCI output by the service application layer SAL is some general type of information generated by the service application layer SAL depending on its internal functionalities (services and/or applications), i.e. dependent on the facilities provided by the servers SERV. Thus, as long as the service application layer SAL has a general service application layer information exchange interface SAL-EX for receiving/outputting the respective information PSI; PCI, TCI, also the service application layer SAL can easily be exchanged with another service application layer SAL with the same advantages as described above for the traffic control layer TCL and the traffic signalling layer TSL.

According to yet another embodiment of the traffic management system TMSYS, the system TMSYS comprises a communications layer CL providing communications facilities CF for communicating information and the communication layer also comprises a communication layer information exchange interface CL-EX. This exchange interface CL-EX is adapted to receive the traffic signalling information TSI about the vehicle traffic C1, Cx on the physical layer PL from the traffic signalling layer TSL, and to output the traffic signalling information TSI communicated through the communications facilities CF to the traffic control layer TCL and/or the services application layer SAL.

Furthermore, the exchange interface CL-EX is adapted to receive the traffic control information TCI from the traffic control layer TCL and/or the services application layer SAL, and to output the traffic control information TCI communicated through the communication facilities CF to the traffic signalling layer SAL. Thus, also the communication layer CL can be easily exchanged with another communication layer CL comprising other communication facilities CF with again the same advantages as described above.

According to a further embodiment of the communication layer CL, the communication layer exchange interface CL-EX is further adapted to receive the traffic control information TCI from the traffic control layer TCL and/or the service application layer SAL, and to output the traffic control information TCI communicated through the communication facilities CF to the traffic signalling layer TSL.

Thus, the five layer structure shown in FIG. 1 for the inventive traffic management system TMSYS allows in a flexible manner to introduce new functionalities, control and guiding functions within the respective layers without the need to change the complete traffic management system. For example, new functionalities can be added in the service application layer simply by exchanging the complete service application layer without changing the structure of the traffic control layer TCL and/or the traffic signalling layer TSL. If the traffic control layer TCL and the traffic signalling layer TSL is formed by individual traffic control domains and traffic signalling domains, it is even possible to exchange certain domains locally within each layer. Thus, the layered structure of the inventive traffic management system TMSYS allows very flexibly a redesign, modification, extension or adaption to new control functionalities and new traffic situations.

Hereinafter, the individual layers and examples for the individual information exchanged through the respective exchange interfaces will be explained.

Embodiments of the Traffic Arrangement Layers

Figure 2:
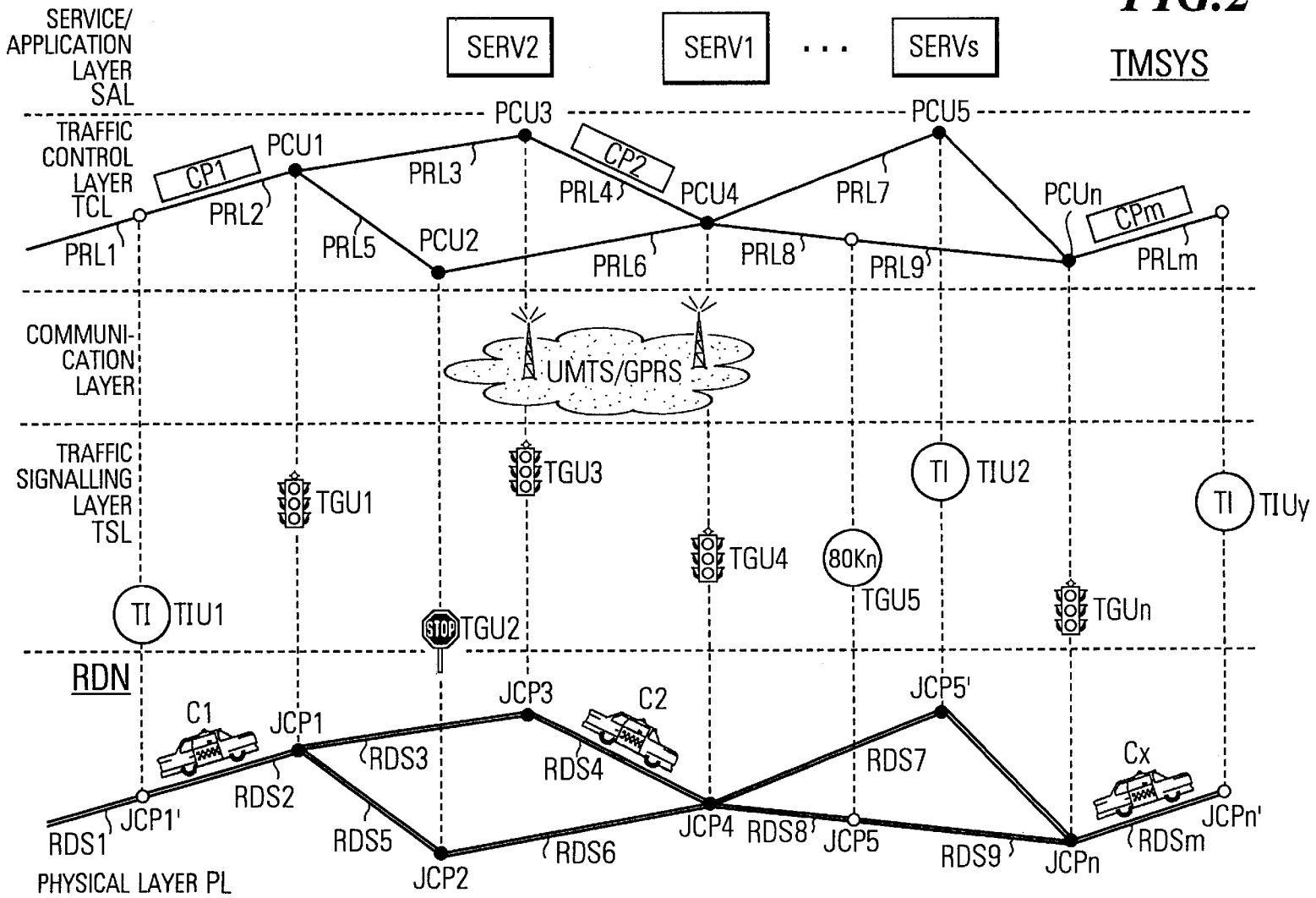
FIG. 2 shows a more detailed block diagram of individual parts used in the individual layers shown in the FIG. 1.

As shown in FIG. 2, the traffic signalling layer TSL comprises as traffic signalling units TSU a number of traffic units TIU, TGU to mainly fulfil two purposes, namely to collect traffic information TI from the physical layer PL and/or to forward this traffic information TI as the traffic signalling information TSI to other higher layers CL, TCL, SAL (in which case the traffic units are TIU traffic information units), and secondly to provide the traffic guidance information TGI to the vehicle traffic on the physical layer PL (in which case the traffic units are TGU traffic guidance units) in order to control, on the physical layer PL, the vehicle traffic.

In cases where only traffic information TI is collected, the traffic management system may be viewed as being in a "monitoring mode" in which it is desired to only perform a monitoring of the traffic flow on the physical layer PL. If traffic guidance information TGI is provided to the physical layer PL the traffic management system may be viewed as being in a "active control mode" in which the traffic flow is influenced, i.e. controlled by means of providing traffic guidance information to the physical layer PL. The "active control mode" may operate in a simple "forward control" in which the traffic signalling layer TSL only provides traffic guidance information TG to the physical layer PL whilst no traffic information TI is collected by the traffic signalling layer TSL. On the other hand, according to another embodiment the traffic management system also performs the "active control mode" in a feedback manner, namely when the traffic information TI collected by the traffic signalling layer TSL is evaluated (as will be explained below in the other layers TCL and/or SAL) and traffic guidance information TGI based on such an evaluation is provided to the physical layer PL. Thus, the traffic management system TMSYS of the present invention operates in different embodiments in the "monitoring mode", the "feed-forward control mode", the "feedback control mode", or the combined feed-forward/feedback control mode. Also a combined "monitoring/control mode" may be vehicleried out.

Although a skilled person will understand that the traffic signalling layer TSL, as will be explained below with more details, comprises for example controllable traffic signs which as such also belong to the "real" physical world, the traffic signalling layer TSL is here included as a separate layer for the following reason. As explained above, the layered system of FIG. 1 operates as a type of feed-forward or feedback control system and the physical layer PL may be viewed (when using control theory) as the object to be controlled. The traffic signalling layer TSL does not really constitute the object to be controlled (the object to be controlled is the traffic flow and not any traffic signs) and units (traffic signs and/or on-board navigation systems) of the traffic signalling layer TSL according to one embodiment serve (in terms of control theory) as the measurement unit (for measuring the traffic flow) and in another embodiment as the control element (for controlling the traffic flow; for example by displaying traffic guidance information on a display of a vehicle navigation system).

As explained above, the communication layer CL provides communications at least between the traffic control layer TCL and the traffic signalling layer TSL. According to another embodiment, the communication layer CL provides communications also between the traffic signalling layer TSL and the service application layer SAL. The communications are provided by a communication network (i.e. the communication facilities CF) of the communication layer CL. According to one embodiment, the network is a mobile and/or fixed transmission network, especially in the case when communication is provided between the traffic control layer TCL and the traffic signalling layer TSL or the physical layer PL. According to other embodiments, between the traffic control layer TCL and the traffic signalling layer TSL a fixed network (e.g. via cables) or a mobile network (e.g. GPRS (General Purpose Radio System) or UMTS (Universal Mobile Telephone System)) is used.

Between the traffic control layer TCL and the physical layer PL a mobile network can be used (e.g. GPRS or UMTS) if information needs to be collected from the physical layer PL. For example, if information can only be collected from or provided to individual vehicles forming the traffic flow a mobile network needs to be used because vehicles are of course mobile. That is, essentially a PLMN (Public Land Mobile Network) is needed when collecting information from traffic guidance units TGU arranged inside vehicles. The PLMN may also be used for obtaining a vehicle ID, the speed and/or direction of a vehicle or other telemetric data needed by one or more of the layers of the traffic management system. Alternatively, the PLMN or a fixed network can be used to provide information collected by static sensors on the physical layer or the traffic signalling layer to/from the traffic control layer.

Thus, it should be understood that the communication layer CL, although being drawn in-between the traffic control layer TCL and the traffic signalling layer TSL also provides communications between other layers and a skilled person will select an appropriate mobile or a fixed network depending on the type of communication needed between the different layers.

In a case of a mobile network the communication layer CL contains the radio access network RAN and the core network CN. The main purpose of this communication layer CL is to provide the connection and communication between the traffic control layer TCL and the traffic signalling layer TSL and the service application layer SAL. It takes care of the radio resource management and the mobility management for mobile terminals possibly arranged in one of the vehicles C on the physical layer PL.

As explained above, traffic control layer TCL comprises a packet switched control network PSCN, in which a packet traffic takes place. Depending on the operation mode of the traffic management system of the invention the traffic control layer TCL may carry out one or more of the following three purposes. Firstly, when the traffic management system TMSYS performs a simple "monitoring mode" the packet switched control network PSCN in the traffic control layer TCL will generate, delete and route packets in the packet switched control network PSCN in such a manner that the packets correspond to actual physical vehicles entering, leaving and moving around in the physical layer PL.

Secondly, if the traffic management system TMSYS operates in a "feed-forward or feedback control mode", the PSCN in the traffic control layer TCL will generate, delete and route packets in the packet switched control network PSCN and will at the same time provide control information to the traffic signalling layer TSL such that the vehicles on the physical layer PL are guided (via traffic guidance information from traffic guidance units) on the road network RDN of the physical layer PL similar as the packets are routed within the packet switched control network PSCN.

Thirdly, the traffic management system may also operate in what may be called a "simulation mode" in which the traffic flow on the physical layer PL is simulated for a time interval by generating, deleting and routing packets in the traffic control layer TCL. In one embodiment, this third mode of operation the traffic control layer TCL for example takes a "snapshot" of all vehicles on the road network RDN at a certain point in time and then performs a simulation of a traffic flow within a time interval by routing packets in the packet switched network starting from the "snapshot configuration" of packets in the traffic control layer TCL. According to another embodiment, the simulation can be further influenced by information based on statistical data or external information, e.g. operator settings or other information e.g. reflecting changes in the topology. The third mode of operation in the traffic control layer TCL is particularly advantageous because it allows to make predictions of what kind of traffic situation may have to be expected in say 10 minutes, one hour etc. and on the basis of the evaluation of the packet traffic conditions before the actual traffic situation occurs on the physical layer PL appropriate countermeasures can be set up to avoid certain "bad" traffic conditions such as congestion, slow traffic, overloaded roads etc.

According to one embodiment, the end of the time interval for simulation may be determined by an external event, e.g. reported to the traffic control layer TCL as traffic information TI from the traffic signalling layer TSL or reported from the service application layer SAL.

Furthermore, in another embodiment the simulation process may be influenced by changes in the physical layer PL, the traffic signalling layer TSL and/or any other layer, e.g. a protocol change for the packet switched control network PSCN or a new server on the service application layer SAL. That is, during this kind of simulation it can be assessed how different changes on the various layers will influence the packet traffic to find out how the real vehicle traffic on the physical layer would change in case of certain changes. Based on this assessment an improved routing of packets and thus guidance of vehicles can be performed. Furthermore, modifications on the physical layer, like the introduction of one-way streets, bypasses etc. can be evaluated in advance. By this urban and regional planning can be improved.

The service application layer SAL (more particular a services/application layer) is a general service providing layer. Essentially, the service application layer SAL can communicate with all other layers TCL, TSL and PL by exchanging appropriate information TSI, TCI; PSI, PCI through the communication layer CL. The services may be provided directly to the vehicles (or indirectly to the persons driving the vehicles) and services may also provide complicated traffic decisions. The traffic control layer TCL can contact the service application layer SAL a packet signalling information PSI including packet traffic information PTI and for example request a "complicated" decision from a service and a service application layer SAL. Vehicle owners/drivers may directly control their services by setting and configuring those services in the service application layer SAL.

For "complicated" decisions some form of artificial intelligence may be needed, e.g. a historical database, an analysis from the company/country (providing company/country specific routing guidance), a request from a visitor's processing server (providing specific routing guidance for vehicles from other countries), etc. "Complicated" means here that (many) specific issues have to be taken into account in addition to the basic handling provided by the TCL/PSCN).

Depending on the management function to be performed by the traffic management system TMSYS there can be distinguished a number of different traffic information flow and/or control information flow conditions the details of which will be explained below with more details. For example, during the "monitoring mode" traffic signalling information TSI including traffic information TI can be provided to the traffic control layer TCL in which packet control unit control information PCU-CI is provided to packet control information PCI to packet control units of the packet switched control network PSCN and/or from which traffic guidance unit control information TGU-CI is provided as traffic control information TCI to the traffic guidance units TGU of the traffic signalling layer such that the packet flow in the packet switched control network is controlled to correspond to the vehicle flow. Furthermore, packet signalling information PSI including packet traffic information TI can be provided to the service application layer SAL which can in turn as packet control information PCI provide a corresponding packet control unit control information PCU-CI to the traffic control layer TCL.

In the "feed-forward control mode" the packet switched control network PSCN routes the packets and provides as traffic control information TCI traffic guidance unit control information TGU-CI directly downwards to and/or first upwards (as packet signalling information PSI) to the service application layer SAL and then downwards to the traffic signalling layer TSL to provide corresponding traffic guidance information to the physical layer PL. In a "feedback control mode" additionally to providing control information TGU-CI to the traffic signalling layer TSL (from the traffic control layer TCL or the service application layer SAL) control information may be provided to the traffic control layer TCL and/or the service application layer SAL. These conditions will be described below with more detail.

As shown in FIG. 2 the traffic management system TMSYS according to the invention comprises on the physical layer PL the road network RDN on which a plurality of vehicles C1-Cx travel. The road network RDN comprises a plurality of road sections RDS1-RDSm and a plurality of road points ICP1-ICPn located at the road section RDS1-RDSm. According to one embodiment, the road points ICP1-ICPn are for example located at portions of the road network RDN where two or more road sections RDSm are interconnected or where one road section is started/ended. In this case the road points serve as interconnection road points at which road sections are connected. For example, the interconnection road point ICP1 is a road point where three road sections RDS2, RDS3, RDS5 are interconnected, and the interconnection road point ICP2 is a road point, where only two road sections RDS5, RDS6 are interconnected. For example, ICP1 may be a road crossing and ICP2 may merely be a point along a road, where a bend occurs.

Furthermore, according to another embodiment, the road points can also be located along the roads as for example indicated with the road points ICP1', ICP5'. Furthermore, according to yet another embodiment, road points can also be located at the end of a road as illustrated with the road point ICPm at the road section RDSm. For example, the road point ICPm may be the end of a road (dead end) or may be located on the boundary of the geographical area for which the traffic management system TMSYS is intended to perform traffic management.

As explained above, the traffic control layer TCL according to the invention comprises the packet switched control network PSCN in which the packet traffic constituted by a plurality of vehicle packets CP1-CPx being routed along a plurality of packet routing links PRL1-PRLm is controlled by a plurality of packet control units PCU1-PCUn located at said packet routing links PRL1-PRLm. As indicated in FIG. 2, the packet switched control network PSCN on the traffic control layer TCL is configured in such a way that the packet routing links PRL1-PRLm correspond to the road sections RDS1-RDSm, the packet control units PCU1-PCUn correspond to the road points ICP1-ICPn and each packet CP1-CPx routed along a respective packet routing link PRL1-PRLm corresponds to or simulates at least one vehicle CR1-CRx travelling on a corresponding road section RDS1-RDSm.

However, there need not necessarily be a one-to-one relationship between a packet control unit PCU and a road point ICP. That is, one packet control unit PCU may control by means of exchanging traffic control information TCI including the traffic guidance unit control information TGU-CI several traffic guidance units TGU located at a respective road point or one traffic guidance unit TGU may be controlled by several packet control units PCUs, i.e. PCU:ICP <->n:m. This equally well applies to the monitoring mode, e.g. one traffic information unit TIU can provide as traffic signalling information TSI traffic information TI to one or more of the packet control units and several traffic information units TIU may provide traffic information TI to a single packet control unit.

More specifically, the packet control units PCU1-PCUn are adapted to control the packets CP1-CPx on a respective packet routing link PRL1-PRLm in the traffic control layer TCL to correspond to or simulate a respective vehicle C1-Cx on a corresponding road section RDS1-RDSm on the physical layer PL.

Thus, in a method for managing in the road network RDN the vehicle traffic formed, on the physical layer PL, by a plurality of vehicles C1-Cx travelling along a plurality of road sections RDS1-RDSm of the road network RDN and a plurality of road points ICP1-ICPn located at said road sections RDS1-RDSm of the road network RDN a first step resides in configuring the packet switched control network PSCN on a traffic control layer TCL including a plurality of packet routing links PRL1-PRLm and a plurality of packet control units PCU1-PCUn located at said packet routing links PRL1-PRLm in such a manner that packet routing links PRL1-PRLm correspond to roads sections RDS1-RDSm and packet control units PCU1-PCUn correspond to road points ICP1-ICPn. In this manner, it is ensured that the packet switched control network configuration corresponds to the road network configuration.

Having configured the packet switched control network in the above described manner, a second step of the method in accordance with the invention is to control the packet control units PCU1-PCUn in such a manner that the packets CP1-CPx are routed along respective packet routing links PRL1-PRLm such that they correspond to or simulate at least one vehicle CR1-CRx travelling on a corresponding road section RDS1-RDSm.

For performing the above method, in one embodiment of the invention a computer program product stored on a computer readable storage medium comprising code means adapted to carry out the above mentioned method steps is used.

However, the traffic control layer TCL and traffic signalling layer TSL having been configured as described in the above steps of the method of the invention can also be configured independently. That is, for a given distribution of traffic signalling units TSU and a traffic signalling layer TSL, different traffic control layers TCL, for example containing different distributions of packet control units, can be inserted or exchanged for the existing traffic control layer. Likewise, for a fixed configuration in the traffic control layer, a new network of traffic guidance units and traffic information units as traffic signalling units can be employed on the traffic signalling plane, simply by exchanging the traffic signalling layer TSL, as long as it is guaranteed that the respective information exchange interfaces receive the informations as indicated in FIG. 1.

Of course, the packets Cx in the packet switched control network PSCN are routed by the packet control units PCU (e.g. packet routers) faster than the actual corresponding vehicles can drive on the corresponding road sections. However, according to the invention, a synchronization of a logical packet with the actual vehicle can be performed by delaying a respective packet in the packet control units (e.g. in the routers) until the corresponding vehicle has reached the corresponding road point. Furthermore, in a packet routing link normally the bandwidth is determined by the number of packets per unit time. Therefore, the bandwidth of the packet routing links in the packet switched control network PSCN is determined by the vehicle traffic capacity of a corresponding road section.

Thus, the packet traffic flow in the packet switched control network PSCN is a complete "packet switched" reflection of the real vehicle traffic flow on the physical layer PL. That is, the driving of the vehicles on the physical layer PL along the roads is reflected into a transfer or routing of packets in the packet switched control network along specific corresponding packet routing links.

The transfer or routing of the packets in the packet switched_control network PSCN is not only the mere routing in the sense of simply routing the respective packet in a particular direction from one PCU the next PCU but may also take into account so-called QoS requirements (Quality of Service) for the routing, i.e. a routing which also includes e.g. that the shortest (distance, time, cost etc.) route is to be taken by the packet. Some well known QoS type routing mechanisms (such as DiffServ, RSVP or MPLS) may be employed in the packet switched control network PSCN and will be explained below.

This provides a more efficient traffic management system (whatever function it carries out, as will be explained below) because the packet switched control network PSCN on a traffic control layer TCL can be a clear reflection of what happens in the physical world and therefore all monitoring, feed-forward, feedback and simulation or statistical processing can be performed with respect to a packet switched network and its routing functions. Hence, also predictions of the vehicle traffic to be expected in the future can be performed.

It should be noted that this aspect of mirroring the physical world into a packet switched network is also independent from the type of routing protocol or routing method used in the traffic control layer TCL. A few examples will be explained below.

On the traffic signalling layer TSL, as explained and illustrated in FIG. 2, there are one or more traffic information units TIU1-TIUy which are adapted to collect as traffic signalling information TSI traffic information TI1-TIy about the traffic on the physical layer PL and to provide said traffic information TI1-TIy as traffic signalling information TSI to the traffic control layer TCL and/or to the service/application layer SAL. As explained above, the communication layer CL provides the communication at least between the traffic control layer TCL and the traffic signalling layer TSL such that the collected traffic information TI1-TIy from the traffic information units TIU1-TIUy can be provided to the traffic control layer TCL.

The traffic information TI collected as traffic signalling information TSI by the traffic information units can be a variety of different information for the traffic control layer TCL or the service application layer SAL to carry out their respective functions. In one embodiment of the traffic information TI units the traffic information units are arranged at road points, e.g. ICP1', ICP5', ICPn' as illustrated in FIG. 2. The traffic information can for example be the number of vehicles passing a certain road point, the identification of a particular vehicle (vehicle identification) the speed of the vehicles and/or specific vehicles on a road section.

On the other hand, information about the type of vehicle on the road section, the starting or stopping of a vehicle etc. or even information about the road sections themselves, for example whether the road has one or more than one lane in each direction, whether the road is one-way road or a bi-directional road, the type of road (Broad, dual carriage way, motor way etc.) or whether the road has an inclination, e.g. in mountainous areas is typically given by an operator but may also be given by a specific traffic information unit as traffic signalling information. It is most likely that the information is entered by means of a configuration process. However, in case of dynamic traffic signs, the dynamic traffic signs may provide the information (the "status") to the TCL/SAL in case a status change may be triggered by an external event (such as a manual intervention).

A skilled person can derive further examples of the traffic signalling information TSI based on the above teachings and therefore the invention is not limited to the above-described examples.

According to another embodiment of the traffic signalling units TSU. The traffic information units TIU may also be arranged inside the vehicles C1, C2, Cx, for example with respect to a navigation device which uses a GPS (Global Positioning System) in which case the provided traffic information can also be a location information of the vehicles. A typical traffic information TI provided as traffic signalling information by traffic information units TIU arranged inside vehicles can for example be some type of destination information needed by the traffic control layer.

According to yet another embodiment of the traffic signalling units TSU, traffic information units TIU may also be partially provided by devices arranged at and/or inside the vehicle and/or devices arranged at the road sections. For example, if traffic signalling information is to comprise some type of identification of a vehicle, an identification tag can be provided somewhere at the vehicle, for example at the number plate, and a corresponding sensor can identify a particular vehicle if it recognizes the specific identification tag. According to one embodiment, such an identification tag may not be passive (for example, a sensor may scan the number plate and read by image processing the identification tag) and according to another embodiment it may also be active, e.g. it may radiate (via radio or infrared) its identification in which case the device of the traffic information unit arranged at the road point contains a corresponding receiver. Thus, as traffic signalling units TSU traffic information units TIU may be provided at the road points and/or inside or at the vehicles to provide corresponding traffic information. However, the traffic signalling information TSI, according to one embodiment, also comprises information like the current speed and/or the distance to other vehicles etc.

Furthermore, it should be noted that according to yet another embodiment of the traffic signalling units TSU traffic information units TIU can also be co-located with traffic guidance units TGU (which will be described below) or may even be merely constituted as an additional function of a traffic guidance unit TGU.

As mentioned before, the traffic signalling layer TSL also comprises as traffic signalling units TSU one or more traffic guidance units TGU1-TGUy which are adapted to control the vehicle traffic on the physical layer PL by outputting traffic guidance information TGI1-TGIy dependent on respective traffic control information TCI including traffic guidance unit control information TGU-CI1 to TGU-CIy. Like the traffic information units TIU1-TIUy also the traffic guidance units TGU1-TGUy may be arranged at road points ICP1-ICPn or inside a vehicle. Of course, the skilled person realizes that in the most simple case the traffic guidance units TGU are traffic signs like traffic lights TGU1, TGU3, TGU4, TGUn, stop signs TGU2, speed limits TGU5 etc. wherein the traffic guidance information TGI is generally a traffic direction information (turn left, turn right etc.) and/or a speed adjustment information (stop, red traffic light, green traffic light, speed adjustment). In the case where the traffic guidance unit is arranged within the vehicle, it can for example provide traffic guidance information to a driver on a display screen as for example in a conventional navigation device. In a case where the traffic information units and/or traffic guidance units are arranged within a vehicle, the communication layer CL can comprise a radio system, for example a GPRS network and/or a UMTS network in order to provide the respective traffic information or traffic guidance unit control information between the traffic signalling layer TSL and the traffic control layer TCL. Furthermore, as also shown in FIG. 2, the service application layer SAL includes at least one server SERV1, SERV2, . . . , SERVs, such that at this point the basic structure and the individual parts of each layer have been described.

As explained above, there are various types of information which are collected, generated and exchanged between the individual five layers. However, the basic type of information which is needed can always be seen as part of the most general information shown in FIG. 1. That is, as long as it is guaranteed that some type of general or basic information as shown in FIG. 1 is exchanged between the individual layers, it can be guaranteed that the layers can be individually exchanged, modified, and adapted without the need to exchange all layers at the same time for providing new functionalities.

Hereinafter, the more specific interaction and functioning of the individual layers are described with reference to FIG. 3. The information flow between the different layers for the traffic management system to carry out the respective functions is shown in FIG. 3.

Packet Management and Monitoring Mode

Figure 3:
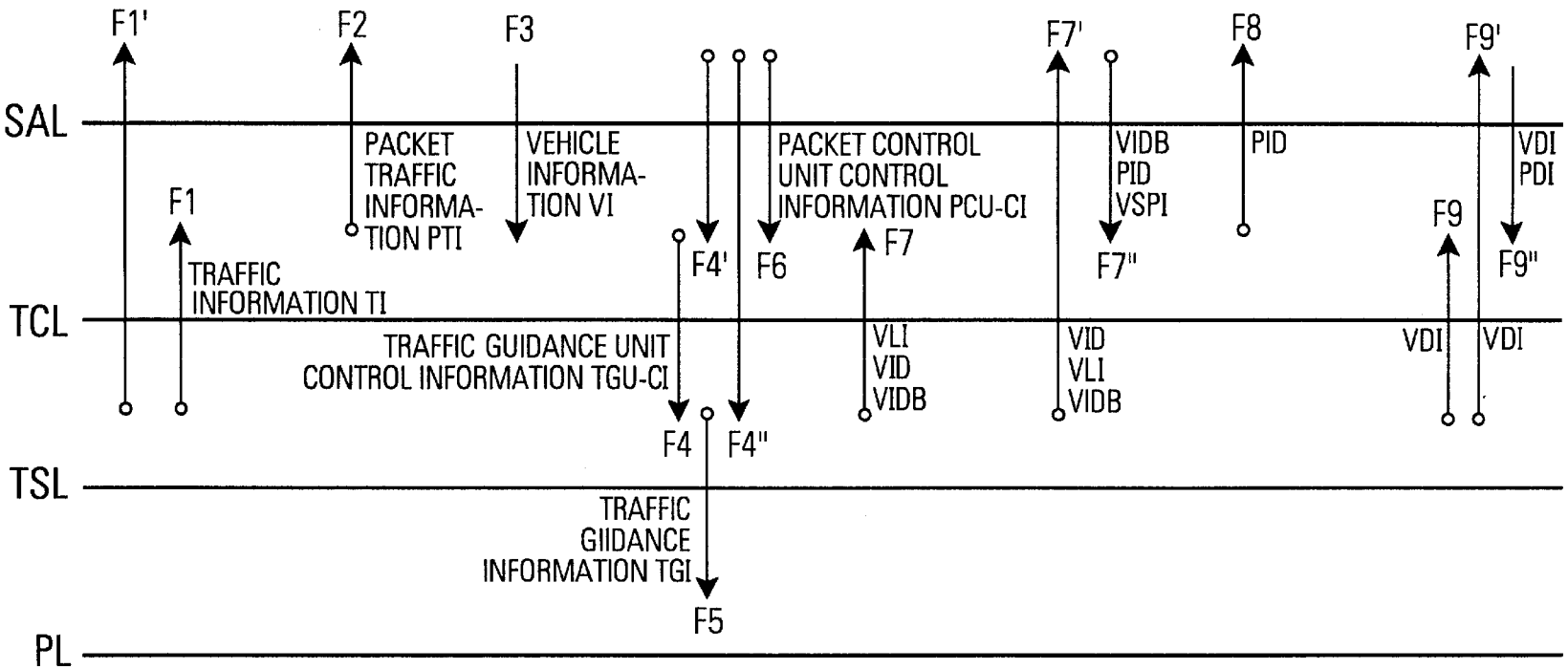
FIG. 3 shows the operation of the traffic management system with respect to the exchange of information between the individual layers.

As mentioned above, the traffic information units (possibly co-located or even arranged inside a traffic guidance unit) provide traffic information TI to the traffic control layer TCL (information flow F1 in FIG. 3). This traffic information TI is part of the traffic signalling information shown in FIG. 1. On the basis of this traffic information TI the packet control units PCU1-PCUn are adapted to generate and/or delete and/or route vehicle packets CP1-CPx on the packet routing links dependent on said traffic information TI. According to another embodiment, the traffic information TI from the traffic information units TIU may also be provided as the packet control information PCI to the service application layer SAL which can for example generate some statistical data of the occurring vehicle traffic flow for monitoring or control purposes (information flow F1' in FIG. 3). The service application layer SAL may also use the traffic information TI from the traffic information units TIU to generate from this information a packet header which is then provided as packet control unit control information PCU-CI to the traffic control layer TCL (see information flow F6 in FIG. 3).

When a driver starts his vehicle or if a new vehicle is detected on one of the road sections the traffic information can indicate that one further vehicle (or a specifically identified vehicle) starts participating in the vehicle traffic on the physical layer PL. In this case a packet control unit arranged at the road section where the new vehicle is detected generates a new packet. Likewise, when a vehicle stops or is involved in an accident, a packet may be deleted by a corresponding packet control unit. Of course, in a most general case for monitoring the packets are routed on the packet routing links dependent on said traffic information and/or packet control unit control information, i.e. on each packet routing link corresponding to a road section the number of vehicles (as well as their driving direction) and the speed (and possibly their identification) of the vehicles correspond to a number of packets (in the corresponding packet travel direction), with readjusted delay times corresponding to the speed and possibly having a packet identification corresponding to a vehicle identification (as will be explained below).

Therefore, in the most simple case, in which traffic information TI is simply provided from the traffic signalling layer TSL to the traffic control layer TCL as the traffic signalling information TSI, a vehicle traffic occurring in the physical layer PL is mapped into a corresponding packet traffic in the packet switched control network PSCN.

In one embodiment (and also during the other control and simulation modes, as will be explained below) the service application layer SAL can receive as packet signalling information PSI packet traffic information PTI from the traffic control layer TCL (see information flow F2) wherein said packet traffic information PTI indicates the packet traffic in the packet switched control network PSCN on the traffic control layer. In accordance with another embodiment, this packet traffic information PTI may be accompanied by signalling information, such as e.g. a code, to indicate a routing question for the service application layer SAL.

In accordance with another embodiment, the traffic signalling layer TSL may provide as traffic signalling information TSI traffic information TI directly to the service application layer SAL and in turn the service application layer will generate—on the basis of this traffic information and possibly some further information from the traffic control layer—some packet header for a new packet and will provide this packet header to the traffic control layer.

On the basis of the provided packet signalling information PSI including the packet traffic information PTI (see information flow F2 in FIG. 3) said at least one server SERV can generate statistical information about the vehicle traffic on the physical layer PL. As mentioned before, according to another embodiment the server SERV can also receive traffic information TI directly from the traffic signalling layer TSL (see information flow F1') and can provide statistical information about the vehicle traffic on the basis of the traffic information TI and/or the packet traffic information PTI. According to yet another embodiment, the service application layer SAL can also provide as packet control information PCI vehicle information to the packet switched control network PSCN as indicated with the vehicle information flow F3 in FIG. 3.

Whilst the "monitoring mode" of the traffic management system as described above is the simplest monitoring function for a specific monitoring case, which the traffic management system TMSYS according to one embodiment performs, hereinafter the more complicated control functions of the traffic management system TMSYS will be described.

Simple Control (Vehicle Non-specific)

In contrast to the monitoring mode where essentially the packet traffic is adapted to the vehicle traffic, in a simple non-vehicle specific control mode, the vehicle traffic is routed according to the packet traffic as obtained with the predetermined control method for packet routing in the packet switched control network PSCN. Therefore, traffic guidance units TGU1-TGUy of the traffic signalling layer TSL receive as traffic control information TCI traffic guidance control information TGU-CI1 to TGU-Cyy from the traffic control layer TCL, for routing vehicles according to the routing of the corresponding packet. The traffic guidance units TGU1-TGUy then output corresponding traffic guidance information TGI1-TGIy to control the traffic on the physical layer PL to correspond to the packet traffic in the packet switched control network PSCN. The packet control units PCU1-PCUn provide said traffic guidance control information TGU-CI1 to TGU-CIy to said traffic guidance units TGU1-TGUy in accordance with the predetermined packet control method. This control corresponds to the information flow F4, F5 in FIG. 3.

In one embodiment of the invention, as also illustrated in FIG. 3, traffic guidance unit control information TGU-CI is provided as the traffic control information TCI from the service application layer SAL to the traffic guidance units TGU1 (information flow F4") and/or traffic guidance unit control information TGU-CI is provided as the packet control information PCI from the service application layer SAL to the traffic control layer TCL and then to the traffic signalling layer TSL (see information flow F4'). In yet another embodiment of the simple control, the service application layer SAL provides packet control information PCI including packet control unit control information PCUCI to the traffic control layer TCL.

For example, when a packet control unit PCU in the packet switched control network PSCN, according to the implemented packet control method (e.g. a protocol), decides that a packet is to be routed to the "left" packet routing link, a corresponding control information TCI is output to a traffic guidance unit such that a traffic guidance information TGI is output which indicates a "left turn" to the next road section lying on the left.

Of course, in the above simple control (non-vehicle specific) there is made one assumption, namely that a vehicle corresponding to a packet pending at a packet control unit, e.g. to be routed to the next left packet routing link will, in response to the corresponding traffic guidance information, also drive to the next "left road" rather than just turning right, going straight or even stopping and returning. In the simple control it is just assumed that vehicles do exactly what they are supposed to do in response to the guidance given by the traffic guidance unit such that the packet traffic is matched to the vehicle traffic. However, the packet switched control network PSCN can be re-synchronized when traffic information TI is provided from the respective traffic information units of the traffic signalling layer TSL to the traffic control layer TCL. When, in the simplest case, the traffic information TI indicates the number of vehicles on the road sections and this information is provided to the traffic control layer TCL, it can at least be guaranteed that on the whole, even when a control is ordered from the traffic control layer TCL, the number of packets on the routing links correspond to the number of vehicles on the road sections. However, although some kind of "feedback control" is carried out (control information being supplied from PSCN to TSL and traffic information provided from TSL to PSCN) the control is still relatively "simple" (and this is why it is called "simple" control), because the control is not individualized, i.e. neither the monitoring nor the control is performed for specific or individual vehicles (and packets).

Monitoring with Identification

According to another embodiment of the invention, the traffic control layer TCL is adapted to receive as said traffic signalling information TSI vehicle location information VLI1-VLIx of the location of the vehicles C1-Cx and vehicle identification information VID1-VIDx identifying the respective vehicle or information VIDB1-VIDX based on said vehicle identification information VID1-VIDX, e.g. the type of vehicle that is read. In this case, the traffic control layer TCL can generate and/or delete and/or route packets having a packet identification information PID1-PIDx corresponding to said vehicle identification information VID1-VIDx or said information VIDB1-VIDBx based on said vehicle identification information VID1-VIDx.

In an embodiment of the system, the vehicle identification information VID1-VIDx or the information VID1-VIDBx based on said vehicle identification information VID1-VIDx is provided by the traffic information units TIU1-TIUy of the traffic signalling layer TSL (see information flow F7 in FIG. 3). Identification information of specific vehicles can be provided by the traffic information units in one or more different ways. one embodiment is the tag-receiver system already explained above where the vehicle is provided with an (active or passive) tag identifying the vehicle and a traffic information unit is placed at road points located along the roads or at road crossings. According to another embodiment, especially if the traffic information unit is incorporated in a vehicle (for example as part of a navigation system), the vehicle location and vehicle identification information can be provided by using a GPS system from the navigation system. As explained above, when the traffic information units are incorporated into the vehicles, then the communication layer CL will use a mobile radio network in order to establish the communication between the traffic signalling layer TSL and the traffic control layer TCL. Furthermore, the driver in the vehicle may be prompted, via the navigation system, to input his user ID when starting a vehicle. In this case the vehicle identification information VID not only identifies the specific vehicle but also a specific driver. This information can be combined with the IMSI of a driver, i.e. if the driver is prompted to input his International Mobile Subscriber Identity IMSI, which may be used in the packet switched control network PSCN either as only an identification of the driver (assuming that the driver always drives his own vehicle) or together with an additional vehicle identification (in which a driver can also drive a different vehicle).

The information VIDB based on said vehicle identification information can be a more specific information about the vehicle, i.e. the size of a vehicle, the type of vehicle, the weight of a vehicle, the achievable speed of the vehicle, the height of a vehicle, etc.

Whilst in one embodiment the vehicle identification information VID and the information VIDB based on said vehicle identification information VID is provided by the traffic information units TIU (information flow F7 in FIG. 3), according to another embodiment, the information VIDB based on said vehicle identification information is provided as packet control information PCI by the service application layer SAL. As indicated with the information flow F7' according to this embodiment the vehicle identification information VID is collected by the traffic signalling layer TSL as traffic signalling information TSI and information VIDB based on said vehicle identification information is derived in the service application layer SAL which in turn provides this information based on said vehicle identification information to the traffic control layer TCL as packet control information PCI (see information flow F7" in FIG. 3). As also indicated in FIG. 3, the service application layer SAL and/or the traffic control layer TCL may also receive, according to another embodiment, the vehicle location information VLI (see F7, F7') as traffic signalling information TSI.

According to another embodiment, the service application layer SAL determines on the basis of the vehicle identification information VID, for example received from the traffic signalling layer TSL as traffic signalling information TSI, vehicle-specific information VSPI of the identified vehicles, wherein said service application layer SAL provides said vehicle specific information VSPI to the traffic control layer TCL as packet control information PCI.

This vehicle specific information VSPI can be converted in a packet specific information in the packet switched control network PSCN such that packet control units PCU can detect, together with the vehicle location information VLI, whether a specific packet is on the correct packet routing link corresponding to the vehicle for which the vehicle identification and a vehicle location was provided.

The vehicle-specific information VSPI may also be used in the PSCN to provide a special kind of routing. The vehicle-specific information VSPI can for example be the size of a vehicle, the weight of a vehicle, the type of a vehicle etc. By contrast, the information based on the vehicle identification information may be simply a packet identification in order to supply information to the traffic control layer TCL on the location of a specific vehicle and packet. For example, when vehicle identification information is provided to the service application layer SAL, the information based on said identification information may be the derivation of a packet identification information PID which is also supplied as part of the packet control information PCI to the traffic control layer TCL as indicated with the information flow F7" in FIG. 3.

As already explained above, when the traffic control layer TCL receives vehicle location information VLI and vehicle identification information VID or information VIDB based on said vehicle identification information VID as said traffic signalling information PSI or said packet control information PCI, the traffic control layer TCL will handle packets having a packet identification information PID corresponding to the vehicle identification information. According to another embodiment the traffic control layer TCL provides the packet identification information PID of the packets in respective packet control units PCU of the packet switched control network PSCN as packet signalling information PSI to the service application layer SAL as indicated with information flow F8 in FIG. 3.

When the traffic control layer TCL receives the vehicle identification information VID (see e.g. information flow F7), information VIDB based on said vehicle identification information and/or packet identification information PID (see for example information flows F7' and/or F7") it can thus be made sure, as explained above, that during a feedback control mode, specific individual vehicles will correspond to individualized packets (having a packet identification such as a packet header). As explained above, the type of information needed by the traffic control layer TCL to provide this exact linking or synchronization of vehicles and packets on an individual basis may also be supplied from the service application layer SAL (see information flow F7", F8). The effect of this individualized feedback control mode is that a predetermined packet control method can be used in the packet switched control network PSCN and that on an individualized basis the vehicles will drive along a path through the road network which corresponds to the path which the packets take in the packet switched control network PSCN.

However, whilst the packet routing method (the protocol) in the packet switched control network PSCN might be quite a good one in order to efficiently route the packets (and thus guide the vehicles), even on an individualized basis for individual vehicles, it may still be useful to further influence the routing function of the packet control units PCU by additional packet control unit control information PCU-CI derived and supplied as packet control information PCI from the service application layer SAL. One example is when traffic information TI is provided to the service application layer SAL and this traffic information TI indicates a large number of vehicles on a certain road section such that a "clever" server SERV in the service application layer SAL may decide that—despite all the clever routing functions carried out by the packet switched network itself due to its routing protocol—it may still be useful to further influence the routing in the packet switched control network PSCN and thus in the road network. For example, the service application layer SAL may decide—on the basis of traffic information TI and/or packet traffic information PTI—that it would be useful to "close down a road" (i.e. close down a routing link), "open a further road section" (i.e. open a further routing link), "control the entry/exit of traffic (vehicles) into/from a certain road or area (i.e. control the number of packets (per unit time≡the_bandwidth) flowing into/coming out from a certain section or routing link of the PSCN network), "lengthen the red-phase at a traffic light" (i.e. increase the delay time in the packet control unit corresponding to the traffic control unit), "impose a no-park restriction on a certain road lane" (i.e. increasing the bandwidth on a certain routing link). When the service application layer SAL makes such decisions, the service application layer SAL can provide packet control unit control information PCU-CI as said pocket control information PCI to the traffic control layer TCL which in turn provides corresponding traffic guidance unit control information TGU-CI to the corresponding traffic guidance units TGU as traffic control information ICI.

Another example is when the service application layer SAL receives vehicle identification information and determines vehicle-specific information of the identified vehicles. For example, the vehicle-specific information may indicate a truck in which case a "clever" server SERV in the service application layer SAL may want to close down a road section, which is not suited for a heavy truck. Also in this case the service application layer SAL will provide as packet control information PCI a packet control unit control information PCU-CI to the corresponding packet control units in order to avoid routing the individualized truck vehicle onto a road section, which is not suited for the truck, e.g. which is too narrow, has too low bridges or which cannot take the weight of the truck.

Thus, the packet control unit control information provided by the service application layer SAL a packet control information PCI may also contain configuration information for configuring or re-configuring the packet switched control network PSCN.

According to yet another embodiment of the invention, the service application layer SAL can receive from the traffic control layer TCL as packet signalling information TSI packet traffic information PTI, can process this packet traffic information PTI in accordance with the predetermined processing process and can provide packet control unit control information PCU-CI as packet control information PCI corresponding to the processing to the packet control unit PCU (see information flows F2, F6). That is, the service application layer SAL may monitor the packet traffic in the packet switched control network PSCN and may determine that there are too many packets (i.e. vehicles) on specific routing links or that some packets are too slow (the vehicles have a low speed) such that there is a need for providing control information PCI to the packet control units PCU (in addition to routing functions which the packet switched control network PSCN carried out anyway).

According to one embodiment the packet control unit control information PCU-CI can be a header information H1-Hx for the packets CP1-CPx or a configuration information for configuring the packet switched control network PSCN as explained above.

With the above described embodiments the packet traffic flow in the packet switched control network PSCN and the vehicle traffic on the physical layer PL correspond to each other on an individual basis and further control information from the service application layer SAL can be provided to the packet control units PCU and/or the traffic guidance units in the traffic signalling layer TSL. However, these embodiments do not take into account another very important factor which influences the vehicle traffic on the physical layer PL to a large extent, namely that each vehicle desires to reach a specific destination location. For example, in the morning it may be assumed that a lot of vehicles parked in sub-urban areas will be started (packets will have to be generated in the traffic control layer TCL) and all these vehicles will in principle attempt to reach the center of the nearby city. Of course, since all vehicles essentially have the same "global" destination, this causes severe traffic conditions in the morning and a specific routing to destinations must be provided in order to dissolve such types of traffic jams.

Vehicle Guidance to Destination

According to another embodiment of the invention the traffic control layer TCL receives as traffic signalling information TSI vehicle destination information VDI1-VDIx indicating at least one desired vehicle destination VD1-

VDx. The traffic control layer TCL, more precisely the packet switched control network PSCN, will then, according to a packet control method route packets through the packet switched control network PSCN to a packet destination which corresponds to the vehicle destination. Whilst routing the packet to the packet destination the packet control unit PCU will output as traffic control information TCI corresponding traffic guidance unit control information TGU-CI to the respective traffic guidance units TGU on the traffic signalling layer TSL. Thus, the vehicles are routed to their desired vehicle destination in accordance with the routing of the packets in the packet switched control layer.

Of course, the routing of a vehicle to a desired vehicle destination (corresponding to the routing of a corresponding packet to a packet destination) must be carried out on a vehicle-specific control. That is, together with the vehicle destination information the traffic control layer TCL must as part of the traffic signalling information PSI also receive vehicle identification information VID or information based on this vehicle identification information such that the packet switched control network PSCN can insert the appropriate routing headers and packet identifications corresponding to the vehicle identifications into the packets which need to be routed to the packet destinations.

As shown in FIG. 3 with the information flow F9, in one embodiment the vehicle destination information VDI can be provided directly as traffic signalling information TSI from the traffic signalling layer TSL, for example from a navigation system within a vehicle. According to another embodiment such vehicle destination information VDI can be provided to the traffic signalling layer TSL from a mobile user equipment (telephone, palmtop, laptop etc.) located in the vehicle which needs to be guided to the desired vehicle destination.

According to another embodiment the vehicle destination information VDI is provided as traffic signalling information TSI to the service application layer SAL wherein said service application layer SAL receives said vehicle destination information (indicating at least one desired vehicle destination) and forwards to the traffic control layer TCL as said packet control information PCI said vehicle destination information VDI or processes that vehicle destination information VDI and forwards corresponding packet destination information PDI as packet control information PCI to said traffic control layer TCL. That is, in this embodiment the service application layer SAL recognizes the vehicle destination and determines a corresponding packet destination information PDI and provides the packet destination information as packet control information PCI to the traffic control layer TCL, as shown with the information flows F9', F9" in FIG. 3.

According to another embodiment, the service application layer SAL can receive—instead or in addition to the vehicle destination information—indications of other preferences to be considered as additional routing criteria in the traffic control layer TCL, e.g. a preference for a routing according to a minimum cost, minimum delay, shortest distance etc. as traffic signalling information TSI or as packet control information PCI. Also in this case, the service application layer SAL can provide some appropriate packet control information and/or packet identification information to the traffic control layer TCL as packet control information PCI, which can in turn provide some appropriate traffic guidance unit control information to the traffic signalling layer.

After receiving the vehicle destination information (directly from the traffic signalling layer) or directly a packet destination information PDI from the service application layer SAL, the traffic control layer or the service application layer SAL inserts the packet destination information corresponding to the vehicle destination information in a packet which for example corresponds to the vehicle desiring to travel to said vehicle destination. The packet switched control network PSCN then routes the packet in the packet switched control network to the packet destination indicated by said packet destination information and, as explained above, outputs corresponding traffic guidance unit control information to at least one traffic guidance unit.

For example, when several vehicles provide vehicle destination information of destinations to which they want to be guided, a corresponding packet in the packet switched control network PSCN receives a corresponding packet destination information and—according to the implemented routing protocol—the packets will be routed to their packet destination in the packet switched network. In this case, there is no additional control information provided to the traffic control layer such that the traffic control layer TCL by itself will provide the routing of the packets and, via the traffic guidance unit control information, also the guidance of the vehicles.

However, if the vehicle destination information is provided to the service application layer, the service application layer SAL can also process this vehicle destination information, possibly together with the vehicle location information and vehicle identification information, in order to provide additional packet control unit control information PCU-CI to the packet switched control network PSCN such that specific vehicles (packets) are guided along specific roads. For example, it may make sense if the service application layer recognizes on the basis of some vehicle specific information that the vehicle, which desires to be guided to a destination is a large truck such that it makes more sense to group this truck together with other trucks on the same road. Whilst the packet switched control network PSCN will in such a case merely route the "general" packet to a desired destination, the additional provision of packet control information PCI including packet control unit control information PCU-CI can additionally have an impact on specific packet control units so as to not only route the packets in accordance with the implemented packet control method but also dependent on the additional control information. However, of course other routing aims may be achieved, for example a routing based on minimum delay, minimum cost, maximum bandwidth etc. such that the "fastest" routing is only one of many possibilities.

The most preferable embodiment of guiding vehicles to a desired destination location is of course when the traffic guidance unit is implemented inside a vehicle in which case the traffic guidance information can directly be displayed to a driver of the specific vehicle on a display screen of the navigation system. However, according to another embodiment it is also possible that traffic guidance units such as traffic signs provide specific guidance information to specifically identified vehicles, for example "the next five vehicles should turn left". This is possible because the routing of the packets in the packet switched control network PSCN is synchronized to the vehicle flow on the physical layer PL. Obviously, the advantage over previously known navigation systems is that the traffic guidance unit control information TGU-CI provided to the traffic guidance units is one which is based (derived) while taking into account the routing of other packets (vehicles) to other packet destinations or vehicle destinations on a more global basis, not individually and independently of other vehicles.

Thus, also the embodiments, which use vehicle destination information in the traffic control layer TCL provide more efficient traffic management system in accordance with the invention.

At this point, the traffic management system TMSYS can be used for monitoring, for feed-forward control, feedback control and for specific controls, which take into account the individual vehicles and/or the vehicle destinations. Thus, in accordance with the desired vehicle destinations a routing of the packets and a guiding of the vehicles to the respective destinations can be achieved in accordance with the implemented routing protocol. If the routing protocol is a "clever" one, such as RIP, OSPF, BGP or others, there will normally result traffic conditions with less congestions since also in the packet switched control network the respective packet routing protocol attempts to route packets generally from a starting location to a destination location as fast as possible and with as little congestion as possible.

As explained above, the routing may be performed more efficiently and optimally, however, the routing to the desired destination is not necessarily as fast as possible since other routing criteria for a routing to the destination may be used.

Thus, all the usual advantages of a packet switched control network PSCN in accordance with the employed protocol can be used for routing the packets and consequently guiding the vehicles. Such features of packet switched networks are for example end-to-end data transport, addressing, fragmentation and reassembly, routing, congestion control, improved security handling, flow label routing, and enhanced type of service based routing, unlimited amount of IP addresses, any-casting, strict routing and loose routing.

Other functions of packet routing protocols like a routing according to RIP, OSPF, BGP to find the shortest route (dynamically, near real-time) based on several metrics, charging and accounting mechanisms, token packet algorithms to smoothen the traffic, congestion management and congestion prevention mechanisms, network management systems (such as SNMP), security mechanisms, QoS mechanisms and multicast group registrations according to e.g. the Internet Group Management Protocol (IGMP) can be used.

The routing performed in the packet switched network may also be based on or use one or more features from the Internet Control Message Protocol (ICMP), the Open Shortest Path First (OSPF), the Weighted Fair Queuing (WFQ), a Virtual Private Network (VPN), Differentiated Services (DIFFSERV), the Resource reSerVation Protocol (RSVP) or the Multiprotcol Label Switching (MPLS).

Differentiated services DIFFSERV enhancements to the IP protocol are intended to enable scalable service discrimination in the Internet without the need for per-flow state and signalling at every hop. A variety of services may be built from a small, well-defined set of building blocks that are deployed in network nodes. The services may be either end-to-end or intra-domain; they include both those that can satisfy quantitative requirements (e.g. peak bandwidth) and those based on relative performance (e.g. "class" differentiation). Services can be constructed by a combination of different protocols.

RSVP is a communications protocol that signals a router to reserve bandwidth for real-time transmission. RSVP is designed to clear a path for audio and video traffic eliminating annoying skips and hesitations. It has been sanctioned by the IETF, because audio and video traffic is expected to increase dramatically on the Internet.

MPLS is a technology for backbone networks and can be used for IP as well as other network-layer protocols. It can be deployed in corporate networks as well as in public backbone networks operated by Internet service providers (ISP) or telecom network operators.

MPLS simplifies the forwarding function in the core routers by introducing a connection-oriented mechanism inside the connectionless IP networks. In an MPLS network a label-switched path is set up for each route or path through the network and the switching of packets is based on these labels (instead of the full IP address in the IP header).

When a QoS (Quality of Service) routing is desired, i.e. when e.g. a routing for the shortest distance and/or shortest time and/or lowest cost etc. is to be performed, the DIFFSERV, the RSVP or the MPLS may be preferred. DIFFSERV has different QoS classes but there is no definite guarantee that the required QoS will be fulfilled. With the RSVP the QoS can be guaranteed and it could e.g. be used to ensure that certain vehicles get highest priority in case of an emergency situation (policy etc.).

Furthermore, as already explained the packet switched control network may be subdivided into different domains where possibly different routing features are used in accordance with the needs in this particular domain. For example, if the service application layer SAL receives as packet signalling information PSI packet identification information PID of specific packets in the traffic control layer TCL a server SERV of the service application layer SAL can collect data along which routing links (road sections) the packets (vehicles) are routed (guided) and can, if additionally vehicle identification information is provided, perform an individual charging of the vehicle for using particular road sections. Likewise, when traffic information TI is provided to the service application layer SAL, as traffic signalling information TSI the service application layer SAL may in turn provide packet control unit control information PCU-CI to the traffic control layer TCL in order to open/close routing links, said one-way direction or bi-directional transport on a routing link (corresponding to a bi-directional or one-way traffic in the physical layer PL) or can perform other configurations in the traffic control layer, such as adding routing links and packet control units (new road sections and road points) etc. Therefore, the information flow shown in FIG. 3 and described here is extremely flexible and allows in accordance with the used routing protocol to control the traffic flow on the physical layer PL in an optimal way.

Prediction Schemes

A particularly advantageous use of the packet switched control network PSCN is that it can simulate the vehicle traffic on the physical layer PL by routing packets in the packet switched control network before the actual physical vehicle traffic takes place on the physical layer PL. That is, given a specific starting condition, for example the present distribution of vehicles in the road network given as traffic signalling information TSI, the traffic control layer TCL can set, possibly through the service application layer, the corresponding distribution of packets in the packet switched control network and then start a simulation for a predetermined time interval $\Delta T$ by using a predetermined packet control method. As explained above, the end of the predetermined time interval may be determined by another event such as for example an operator trigger. The simulation can be carried out on the basis of the vehicle destination information VDI (but also other information may be taken into account, e.g. the type of the vehicle, the vehicle origin, etc.). In accordance with one embodiment, the vehicle destination information can also be provided from the service application layer SAL, possibly in terms of packet destination information of the packet control information.

The service application layer SAL, during the simulation, receives as part of the packet signalling information packet traffic information PTI about the packet traffic on the packet routing links PRL1-PRLm and determines the occurrence of packet traffic conditions PTC. For example, a predetermined packet traffic condition may be the accumulation of many packets on a particular packet routing link such that on this packet routing link the delay time may be increased, which would mean, on the physical layer PL, a slowed down real vehicle traffic. However, the predetermined traffic condition may also be e.g. that "5 packets of a specific type of vehicle pass a certain road (packet link) point within a certain time".

Since the simulation is extremely fast, the service application layer SAL can determine, by monitoring the simulation, such "bad" traffic conditions and can already think of appropriate counter measures. Such counter measures will be provided as additional packet control unit control information PCU-CI in the packet control information PCI to the traffic control layer TCL. Therefore, the routing implemented with the routing protocol can be additionally influenced by packet control unit control information PCU-CI in order to avoid certain traffic conditions, which may be undesirable or to make sure that certain desired traffic conditions are reached. When the actual traffic on the physical layer PL then takes place, controlled by the traffic guidance information output by the traffic guidance units in accordance with the traffic guidance unit control information, the traffic control layer TCL will output additional traffic guidance unit control information corresponding to the packet control unit control information as determined by said service application layer SAL to avoid the predetermined traffic condition. Thus, with the simulation one can look into the future and take appropriate counter measures such that bad traffic conditions may not occur. On the other hand, simulation is also used to try out certain scenarios to find out whether these achieve desired results.

Another important aspect of the simulation is that the simulation cannot only be let "loose", i.e. the packet routing is started from an initial condition and the packets will be routed autonomously in accordance with the routing protocol. In accordance with another embodiment of the simulation aspect it is also possible to include certain variations, which can be expected to occasionally take place, i.e. the occurrence of a traffic accident on a road (complete or partial breakdown of a routing link or at least a substantial reduction of the bandwidth), a flatted road (complete breakdown of the routing link) etc. That is, if one routing protocol is used and the simulation is started, the service application layer SAL may also during the simulation provide further packet control unit control information to the packet control units to influence the routing during the simulation in a particular manner. If the simulation is then performed several times with possibly different mechanisms e.g. with different routing and different variations from the different layers or by completely exchanging one or more of the layers, the best routing technique can be determined by monitoring a respective packet traffic in the packet switched control network PSCN during the simulation. Then counter measures are determined in the service application layer and the packet routing network is reset to the initial condition, i.e. synchronized to the distribution of vehicles in the physical layer PL. Since the simulation on a computer is extremely fast, the vehicle traffic will in the meantime not have changed substantially. Even if it has changed substantially, of course a re-synchronization can be made by providing vehicle identification information, vehicle location information and/or traffic information to the traffic control layer TCL and/or the service application layer SAL. Furthermore, simulation may also be done by a parallel network, i.e. having several TCL layers carry out the simulation in parallel.

As can be understood from the various examples of the information flows in FIG. 3, specific control and routing functions may be carried out in the traffic control layer TCL and in the traffic signalling layer TSL depending on the provided information. The following correspondences of the information as shown in FIG. 1 and as shown in FIG. 3 can be identified:

The traffic signalling information TSI comprises the traffic information TI, the vehicle location information VLI, the vehicle identification information VID, the vehicle identification based information VIDB and the vehicle destination information VDI.

The packet signalling information PSI comprises the packet traffic information PTI and the packet identification information PID.

The traffic guidance information TGI in FIG. 1 corresponds to the traffic guidance information TGI in FIG. 5.

The packet control information PCI comprises the packet control unit control information PCU-CI, the traffic guidance unit control information TGU-CI, the vehicle identification VI, the vehicle identification based information VIDB, the packet identification information PID, the vehicle specific information VSPI, the vehicle destination information VDI and the packet destination information PDI.

Finally, the traffic control information TCI comprises the traffic guidance unit control information TGU-CI.

Thus, comparing FIG. 1 and FIG. 3 it becomes clear that only some general type of information as shown in FIG. 1 needs to be exchanged to build up the global traffic management system having the layer structure as shown in FIG. 1 including five layers.

Bandwidth Broker

In the packet switched control network PSCN a situation may occur where for example in a certain domain of the packet switched control network PSCN (comprising a certain number of packet control units interconnected via packet routing links) a high number of packets need to be routed along the respective packet routing links, i.e. where the resources of the packet switched control network PSCN in this domain are used quite heavily. When further packets want to enter this first domain from a neighbouring second domain, the resources of the first domain may not be able to cope with further packets or may not be able to cope efficiently with more packets such that actually the entering packets from the second domain should be rejected.

According to another embodiment of the invention the packet switched control network PSCN is therefore subdivided into domains and within each domain at least one bandwidth broker (hereinafter called the resource management unit) is provided.

The resource management unit keeps track of the use of the resources within the domain and carries out e.g. admission control decisions for packets wanting to enter this domain. For example, each packet control unit can provide information about the currently handled number of packets and the current available bandwidth (possible packets per unit time) on the packet routing links to the resource management unit. Thus, the resource management unit can perform a regional control of resources in the packet switched control network PSCN (and thus likewise in the road network).

However, the resource management unit can not only be used for providing a reservation of resources for an entering packet into the domain but can also be used when a packet control unit within the domain wants to generate a new packet. Therefore, even packet control units in the same domain may make a resource reservation request with the resource management unit and will receive a resource reservation confirmation from the resource management unit.

According to another embodiment of the invention, two resource management units of the second domain from which a packet wants to exit and the first domain into which the packet wants to enter can also communicate in order to negotiate the usage and reservation of resources. For example, one resource management unit of a second domain may indicate to a resource management unit of a first domain that it intends to transfer five packets to the first domain. The resource management unit of the first domain will check the use of resources in the first domain and may indicate to the resource management unit of the second domain a confirmation that the entry of five packets is admitted and it may possibly together with this indication also transfer an indication as to which packet control unit in the first domain can receive the packets. Alternatively, it is of course possible that a packet control unit of the second domain directly makes the admission request to the resource management unit of the first domain.

Thus, the concept of resource management units allows separately administered regional domains to manage their network resources independently, whilst still they cooperate with other domains to provide dynamically allocated end-to-end quality of service QoS.

Since the vehicle traffic in the road network is a reflection of the packet traffic in the packet switch control network, an example regarding the traffic in the road network is illustrative to highlight the function of the resource management unit. An example is assumed where a city centre is a first domain and some villages outside the city centre are other second domains neighbouring the first domain. In the mornings and in the evenings quite heavy commuter traffic may result in an extensive use of resources in the first domain and the resource management unit in the packet switched control network for this first domain will receive corresponding network resource usage information from the respective packet control units.

When a packet from a second domain (village) makes a request to enter the first domain (city centre) the resource management unit may reject such an admission request because of lack of resources (e.g. due to traffic congestions etc.) such that the requesting packet control unit or requesting resource management unit must negotiate with other resource management units of other second domains (villages) regarding an alternative route through other second domains (villages) into the city centre (first domain).

As will be understood from the above example, the subdivision of the entire packet switch control network PSCN into a number of domains with respective resource management units (and thus a corresponding division of the traffic signalling layer TSL into traffic signalling domains) provides the major advantage that resources in the packet switch control network are handled regionally rather than globally for the entire network. By handling the resources regionally rather than globally the resource management units can handle regionally admission control requests and can regionally configure the packet control units in the packets which control network. Together with the admission request the resource management unit may also receive an indication of the required quality of service, which the packet wants to have guaranteed when being routed in the respective domain. The resource management unit can check the resources in the domain and will only admit the packet if the requested quality of service (e.g. lowest time etc.) can be provided.

Industrial Applicability

As explained above, the idea of mapping the vehicle traffic into a packet switched control network, i.e. regarding each vehicle on a physical layer as a packet in a packet switched control network, allows an optimal traffic management, i.e. monitoring as well as control. This basic principle of the invention is independent of the used routing protocol and the packet switched control network. Therefore, the invention should not be seen restricted to any particular kind of packet switched routing network. Examples of the preferred routing protocols are RIP, OSPF, BGP.

Furthermore, as also explained above, since the traffic management system in accordance with the invention is constructed of five layers together with the exchange of the general information through the exchange interfaces it is possible that layers are individually extended, modified or adapted in order to incorporate new functionalities, which may be needed. Having the message exchanged standardized, it is for example possible to exchange the traffic signalling layer comprising traffic signalling units for vehicles by a traffic signalling layer comprising traffic signalling units for trains in order to perform a traffic control on the rail road system while maintaining the structure of the packet switched control network in the traffic control layer.

Although not specifically described here, the exchange interfaces should be seen as the incoming/outgoing ports of each individual layer whilst the respective units in the layers process and/or modify these information in accordance with their functionality. The exchange interface may be seen as a standard interface connected to one or more units of the respective layer and thus acts as a global and standardized message exchange interface thus allowing a flexible exchange and extension of the layers whilst keeping the general interface. Thus, it is only required that a new inserted layer provides the type of indicated information and a completely new possibly more powerful traffic management system TMSYS can be constructed.

Furthermore, the invention is not restricted by the above described embodiments and explanations in the specification. Further advantageous embodiments and improvements of the invention may be derived from features and/or steps, which have been described separately in the claims and the specification.

Furthermore, on the basis of the above teachings a skilled person may derive further variations and modifications of the invention. Therefore, all such modifications and variations are covered by the attached claims.

Reference numerals in the claims serve clarification purposes and do not limit the scope of these claims.

What is claimed is:

1. A traffic management system (TMSYS) for managing in a road network (RDN) the vehicle traffic (C1, Cx) on a physical layer (PL), said traffic management system (TMSYS) comprising a layer structure including at least:

a) a traffic signalling layer (TSL) including a plurality of traffic signalling units (TSU) for monitoring or controlling the vehicle traffic (C1, Cx) and a traffic signalling layer information exchange interface (TSL-EX) adapted a1) to output traffic signalling information (TSI) about the vehicle traffic (C1, Cx) on the physical layer (PL);

a2) to receive traffic control information (TCI) for controlling the vehicle traffic (C1, Cx); and a3) to output traffic guidance information (TGI) to the vehicles (C1, Cx) on the physical layer (PL); and b) a traffic control layer (TCL) including a packet switched control network (PSCN), in which the packet traffic (CP1, CPx) is controlled with a predetermined packet control method to correspond to or simulate the vehicle traffic (C1, Cx) on the physical layer (PL), including a traffic control layer information exchange interface (TCL-EX) adapted b1) to receive traffic signalling information (TSI) about the vehicle traffic (C1, Cx) on the physical layer (PL);

b2) to output traffic control information (TCI) for controlling the vehicle traffic (C1, Cx);

b3) to output packet signalling information (PSI) about the packet traffic (CP1, CPx); and b4) to receive packet control information (PCI) for controlling the packet traffic (CP1, CPx) in the packet switched control network (PSCN).

2. A traffic management system according to claim 1, comprising:

c) a service application layer (SAL) including at least one server (SERV) for providing services to the traffic signalling layer (TSL) or the traffic control layer (TCL), including a service application layer information exchange interface (SAL-EX) adapted c1) to receive said traffic signalling information (TSI) about the vehicle traffic (C1, Cx) on the physical layer (PL);

c2) to receive said packet signalling information (PSI) about the packet traffic (CP1, CPx) in the packet switched control network (PSCN);

c3) to output said packet control information (PCI) for controlling the packet traffic (CP1, CPx); and c4) to output said traffic control information (TCI) for controlling the vehicle traffic (C1, Cx) on the traffic signalling layer (TSL).

3. A traffic management system according to claim 1, comprising:

d) a communication layer (CL) providing communication facilities (CF) for communicating information, including a communication layer information exchange interface (CL-EX) adapted d1) to receive said traffic signalling information (TSI) about the vehicle traffic (C1, Cx) on the physical layer (PL) from the traffic signalling layer (TSL); and d1') to output said traffic signalling information (TSI) communicated through the communication facilities (CF) to the traffic control layer (TCL) or the services application layer (SAL); and d2) to receive said traffic control information (TCI) from the traffic control layer (TCL) and/or the service application layer (SAL); and d2') to output said traffic control information (TCI) communicated through the communication facilities (CF) to said traffic signalling layer (SAL).

4. A traffic management system according to claim 3, wherein d) said communication layer information exchange interface (CL-EX) is further adapted d3) to receive said traffic control information (TCI) from the traffic control layer (TCL) or the service application layer (SAL); and d3') to output said traffic control information (TCI) communicated through the communication facilities (CF) to the traffic signalling layer (TSL).

5. A traffic management system according to claim 1, wherein said traffic control layer (TCL) comprises one or more traffic control domains and said traffic signalling layer (TSL) comprises one or more traffic signalling domains.

* * * * *